US009815214B2

(12) United States Patent
Troop

(10) Patent No.: US 9,815,214 B2
(45) Date of Patent: Nov. 14, 2017

(54) SCISSORS ASSEMBLY

(71) Applicant: Tracy Troop, Charles Town, WV (US)

(72) Inventor: Tracy Troop, Charles Town, WV (US)

( * ) Notice: Subject to any disclaimer, the term of this patent is extended or adjusted under 35 U.S.C. 154(b) by 0 days.

(21) Appl. No.: 14/960,292

(22) Filed: Dec. 4, 2015

(65) Prior Publication Data

US 2016/0176057 A1 Jun. 23, 2016

Related U.S. Application Data

(63) Continuation-in-part of application No. 13/865,324, filed on Apr. 18, 2013, now abandoned.

(51) Int. Cl.
*B26B 13/10* (2006.01)
*B26B 13/08* (2006.01)

(52) U.S. Cl.
CPC ..... *B26B 13/10* (2013.01); *B26B 13/08* (2013.01)

(58) Field of Classification Search
CPC ..... B26B 13/08; B26B 13/10
See application file for complete search history.

(56) References Cited

U.S. PATENT DOCUMENTS 1,031,370 A * 7/1912 Putney ..... B26B 13/285 30/268
2,000,852 A * 5/1935 Langbein ..... B26B 13/10 30/230
2,606,365 A * 8/1952 Pileggi ..... B26B 13/24 30/195
2,676,402 A * 4/1954 Shaler ..... B26B 13/10 30/230
4,133,107 A * 1/1979 Vogel ..... B26B 13/285 30/266
4,406,063 A * 9/1983 Zaitz ..... B26B 13/28 30/230
4,449,300 A * 5/1984 Maledon ..... B26B 13/24 30/230
4,584,770 A * 4/1986 Sabol ..... B26B 13/285 30/230
4,602,431 A * 7/1986 Keel ..... B26B 13/24 30/229

(Continued)

FOREIGN PATENT DOCUMENTS

| | | | |
|---|---|---|---|
| CA | 2 476 670 | * | 2/2005 |
| DE | 592 897 | * | 2/1934 |
| GB | 361756 | * | 11/1931 |

*Primary Examiner* — Hwei C Payer
(74) *Attorney, Agent, or Firm* — Ruth Eure; Emery Tracy

(57) ABSTRACT

A scissors assembly for cutting objects is provided. The scissors assembly comprises a first blade and a second blade each having a first end and a second end with the first ends being sharply pointed. A pivot connection connects the first blade and the second blade. A serrated cutting edge is formed on the first blade between the first end of the first blade and the pivot connection and a plurality of serrated grooves formed on the second blade between the first end of the second blade and the pivot connection. The sharply point first end of the first blade and the sharply pointed first end of the second blade creates a precision point. Upon pivoting of the first end of the first blade toward the first end of the second blade, the cutting teeth of the serrated cutting edge of the first blade interfit with the serrated grooves on the second blade.

10 Claims, 3 Drawing Sheets

(56) References Cited

U.S. PATENT DOCUMENTS

| | | | | | |
|---|---|---|---|---|---|
| 5,153,997 | A * | 10/1992 | Chiavaras | B26B 13/20 | 30/235 |
| 5,421,090 | A * | 6/1995 | Chiou | B26B 13/08 | 30/254 |
| 5,463,814 | A * | 11/1995 | Stowell | B26B 13/12 | 30/232 |
| 5,692,305 | A * | 12/1997 | Roskam | B26B 13/285 | 30/254 |
| 5,758,422 | A * | 6/1998 | Frank | B26B 13/10 | 30/230 |
| 5,860,215 | A * | 1/1999 | Roskam | B26B 13/26 | 30/254 |
| 8,393,083 | B2 * | 3/2013 | Wu | B26B 13/08 | 30/195 |
| 8,756,818 | B2 * | 6/2014 | Fitraki | B26B 13/28 | 30/254 |
| 2005/0223565 | A1 * | 10/2005 | Rutovic | B26B 13/24 | 30/195 |
| 2010/0212165 | A1 * | 8/2010 | Parnazzini | B26B 13/12 | 30/226 |
| 2016/0176057 | A1 * | 6/2016 | Troop | B26B 13/08 | 30/230 |

* cited by examiner

SCISSORS ASSEMBLY

The present application is a continuation-in-part of U.S. patent application Ser. No. 13/865,324, filed on Apr. 18, 2013, now abandoned, entitled "Scissors Assembly", which claims the benefit of priority of provisional patent application Ser. No. 61/659,045, filed on Jun. 13, 2012, entitled "Scissors".

BACKGROUND OF THE INVENTION

1. Field of the Invention

This invention relates generally to scissors assembly and, more particularly, the invention relates to scissors assembly featuring serrated cutting edges as opposed to straight edges allowing point cuts to be more naturally and more easily achieved.

2. Description of the Prior Art

As with any artist or craftsman, a hairstylist must possess a collection of durable, high quality tools to achieve the best possible results. And, like a carpenter needs a hammer or a painter needs a brush, a stylist needs a good pair of scissors assembly. Professional stylists use shears that are crafted from the finest materials, such as titanium, so that they cannot easily rust or too quickly lose their sharpness. Additionally, this scissors tend to be quite versatile, and able to achieve most stylish cuts, whether the cut is sliding, layered, graduated, or sliced. However, the straight cutting edges provided by most salon scissors are not always effective for successfully mastering the popular point cutting technique. Ideal for both men and women and for both thick and fine hair, point cutting is a technique used to texturize the hair, removing the bulk from the ends of the hair so that layers and gradation blend better. Unfortunately, standard scissors tend to leave cuts too blunt, necessitating time-consuming manipulation of the tool and repeated snips to achieve a smart-looking point cut.

SUMMARY

The present invention is scissors assembly for cutting hair and other objects. The scissors assembly comprises a first blade having a first end and a second end with the first end of the first blade being sharply pointed and a second blade having a first end and a second end with the second end of the second blade being sharply pointed. A pivot connection connects the first blade and the second blade. A serrated cutting edge is formed on the first blade between the first end of the first blade and the pivot connection and a plurality of serrated grooves formed on the second blade between the first end of the second blade and the pivot connection. The sharply point first end of the first blade and the sharply pointed first end of the second blade creates a precision point. Upon pivoting of the first end of the first blade toward the first end of the second blade, the cutting teeth of the serrated cutting edge of the first blade interfit with the serrated grooves on the second blade.

The present invention further includes scissors assembly for cutting objects. The scissors assembly comprises a first blade having a first end and a second end with the first end of the first blade being sharply pointed and a second blade having a first end and a second end with the second end of the second blade being sharply pointed. A pivot connection connects the first blade and the second blade wherein the pivot connection is a pivot screw that is adjustable to adjust the interfit of the cutting teeth of the serrated cutting edge and the corresponding serrated grooves. A serrated cutting edge is formed on the first blade between the first end of the first blade and the pivot connection and a plurality of serrated grooves is formed on the second blade between the first end of the second blade and the pivot connection. A first handle portion is formed on the second end of the first blade and a second handle portion formed on the second end of the second blade. The sharply point first end of the first blade and the sharply pointed first end of the second blade creates a precision point. Upon pivoting of the first end of the first blade toward the first end of the second blade, the cutting teeth of the serrated cutting edge of the first blade interfit with the serrated grooves on the second blade.

DETAILED DESCRIPTION OF THE PREFERRED EMBODIMENTS

Figure 2:
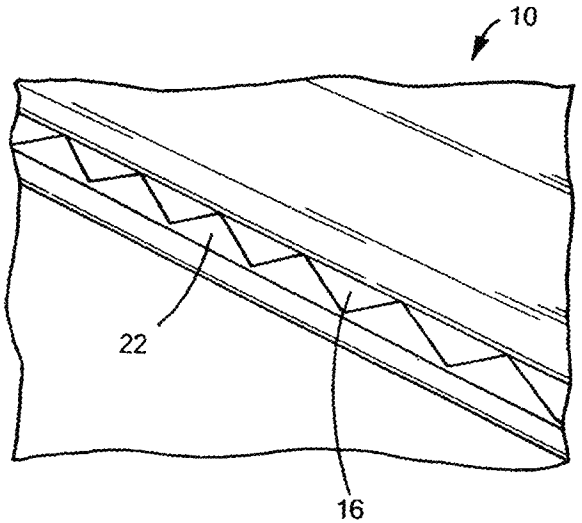
FIG. 2 is a perspective view illustrating the teeth of the scissors assembly, constructed in accordance with the present invention.
Figure 1:
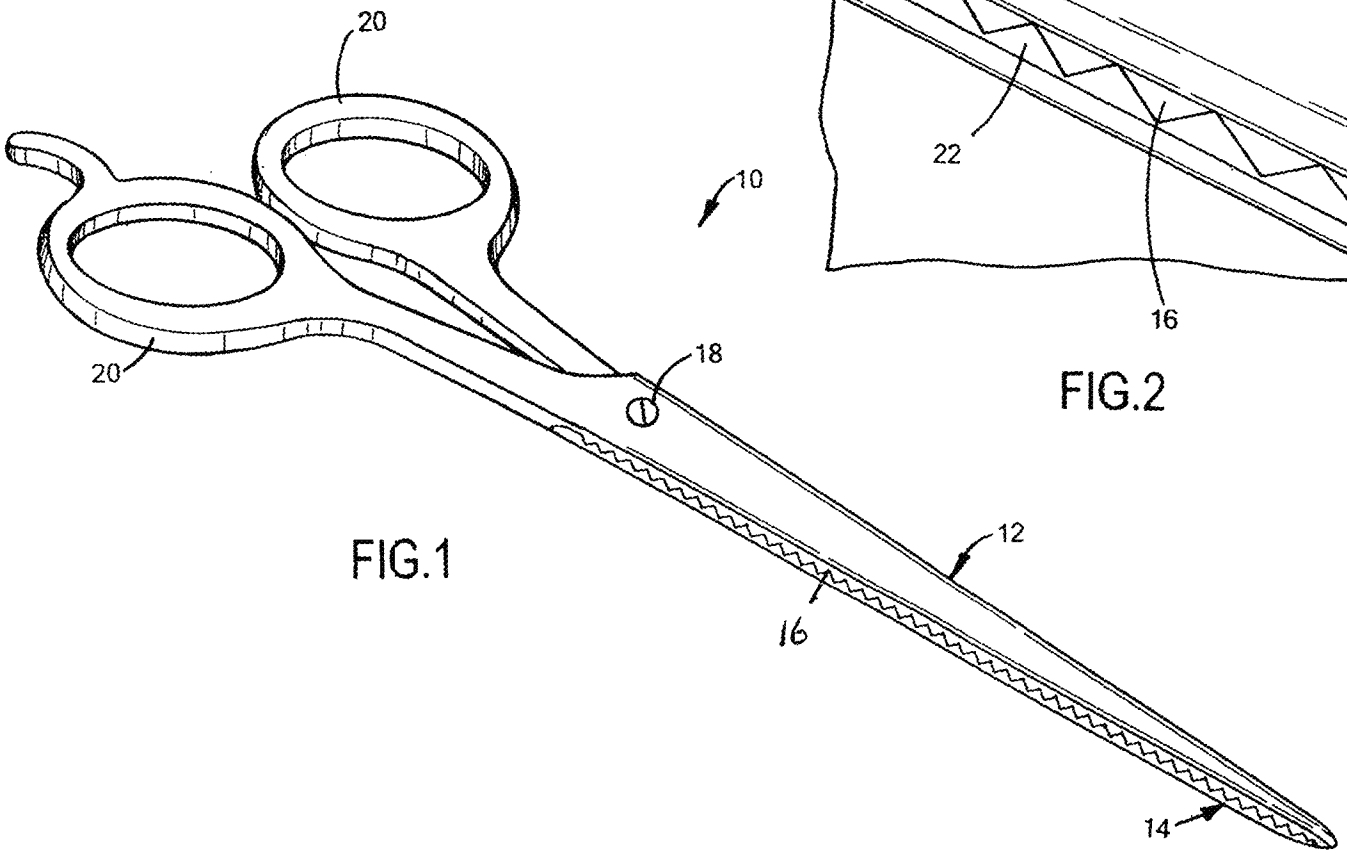
FIG. 1 is a perspective view illustrating a scissors assembly, constructed in accordance with the present invention.
Figure 3:
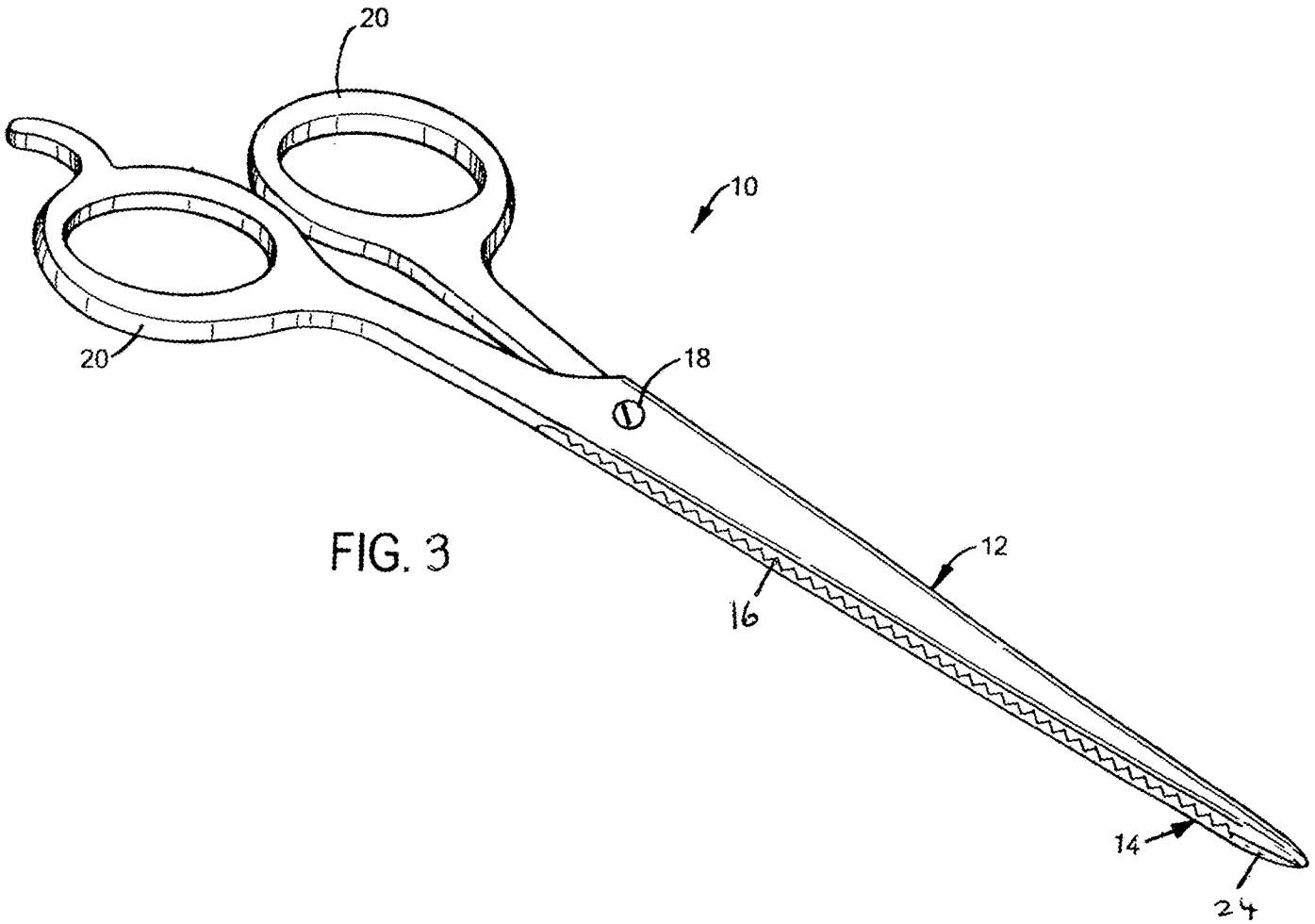
FIG. 3 is a perspective view illustrating a scissors assembly, constructed in accordance with the present invention showing an alternative embodiment for the precision point.
Figure 4:
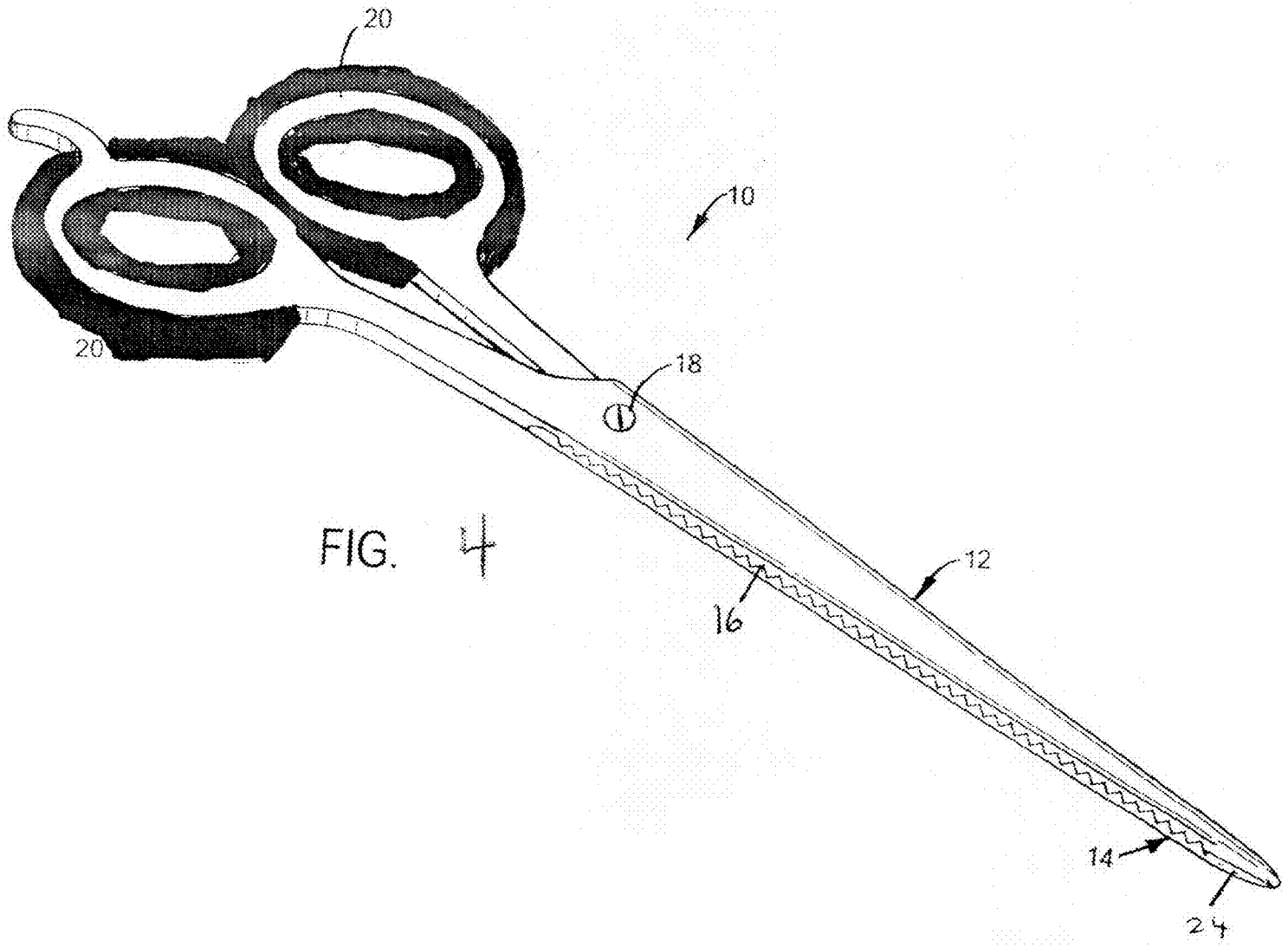
FIG. 4 is a perspective view illustrating the scissors assembly, constructed in accordance with the present invention, with the first handle portion and the second handle portion sheathed with a padding material.

As illustrated in FIGS. 1-3, the present invention is scissors assembly, indicated generally at 10, featuring serrated cutting edges as opposed to straight edges allowing point cuts to be more naturally and more easily achieved. The scissors assembly 10 of the present invention is preferably constructed of durable steel and/or titanium materials and features a variety of sizes to accommodate preferences and different hair textures. It should be noted that the scissors assembly 10 of the present invention can be used on both humans and animals.

The scissors assembly 10 of the present invention has a first blade 12 having a first end and a second end and a second blade 14 having a first end and a second end with a pivot connection 18 connecting the first blade 12 and the second blade 14. A serrated cutting edge 16 is formed on the first blade 12 between the first end of the first blade 12 and the pivot connection 18. A plurality of serrated grooves 22 is formed on the second blade 14 between the first end of the second blade 14 and the pivot connection 18. Yet, unique to scissors assembly 10 is found in the aforementioned serrated cutting edge 16 on the first blade 12. The first blade 12 of the scissors assembly 10 offers a line of rigid, sharp serrations, or "crocodile teeth," that fit flush into the corresponding serrated grooves 22 formed on the second blade 16 with the serrations or cutting teeth of the serrated cutting edge 16 interfitting with the serrated grooves 22 when the scissors assembly 10 are closed, i.e., the first blade 12 is moved in a general direction toward the second blade 14.

In a preferred embodiment, the first end of the first blade 12 and the first end of the second blade 14 are sharply pointed creating a "precision point" for the hair stylist to artfully craft a client's hair with precision as compared to blunt end scissors. In one embodiment, the serrated cutting edge 16 of the first blade 12 extends along the entire first blade 12 from the pivot connection 18 to the first end of the first blade 12 and the corresponding serrated grooves 22 of the second blade 14 extend along the entire second blade 14 from the pivot connection 18 to the first end of the second blade 14. However, in a preferred embodiment, the serrated cutting edge 16 of the first blade 12 extends only partially along the entire first blade 12 from the pivot connection 18 to the first end of the first blade 12 and the corresponding serrated grooves 22 of the second blade 14 extend only partially along the entire second blade 14 from the pivot connection 18 to the first end of the second blade 14. In this embodiment, the area immediately adjacent the pointed first end of the first blade 12 and the second blade 14 allow the hair stylist a precision cut of the client's hair.

At the second end of the first blade 12 and the second blade 14 of the scissors assembly 10 of the present invention is a pair of handles 20. Preferably, the handles 20 of the scissors assembly 10 are sheathed with stylist-grade padding for a comfortable, confident grip.

The pivot point 18 of the first blade 12 and the second blade 14 of the scissors assembly 10 of the present invention is preferably a pivot screw. In a preferred embodiment, the pivot screw 18 is positioned nearingly adjacent the starting point of the serrations on the serrated cutting edge 16 of the first blade 12. The pivot screw 18 facilitates optimal adjustment of the scissors assembly 10 allowing the user to adjust the interfit of the serrations or cutting teeth on the serrated cutting edge 16 of the first blade 12 with the serrated grooves 22 of the second blade 14.

The manner of use of the scissors assembly 10 of the present invention will now be described. It will be understood by those skilled in the art that the manner of use of the scissors assembly 10 described herein is merely one method of use and other methods of use of the scissors assembly 10 are within the scope of the present invention.

To use the scissors assembly 10, a stylist or barber need only position the scissors assembly 10 perpendicular to the fingers so that they are parallel with the hair. Opening and closing the scissors assembly 10, the user snips away the hair in the textured fashion desired. To remove more hair with each cut, the user adjusts the pivot screw 18 to help position the scissors assembly 10 at a slight angle. As an additional consideration, the scissors assembly 10 can be offered in a variety of attractive colors to appeal to individual tastes.

The scissors assembly 10 of the present invention affords professional barbers and hairstylists many significant benefits and advantages. Foremost, the scissors assembly 10 ensures accurate, beautifully mastered point cuts with every snip. Offering cutting edges configured with serrated edges as opposed to the common straight edge, the scissors assembly 10 are able to facilitate a more natural lying of the hair when texturing. As a result, the first cut is not as blunt and boxy, necessitating repeated snips in order to craft the hair with "point precision." Hence, the scissors assembly 10 eliminates the need for stylists an barbers to spend excessive time and energy on a client's hair, an advantage that will be appreciated by both the professional and the client. The latter delights in the results offered by the scissors assembly 10, as their hair is transformed into a unique style that is also fuller and more natural than typically achieved with a common cut. Not just for salon usage, the scissors assembly 10 proves an ideal accessory for skilled home stylists, as well.

The scissors assembly 10 of the present invention readily enhances the ability to finely craft hair when engaging in point cutting. Universal in design, the scissors assembly 10 proves an invaluable addition to salons, and homes, the world over.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein may be suitably practiced in the absence of the specific elements which are disclosed herein.

What is claimed is:

1. A scissors assembly for cutting objects, the scissors assembly comprising:

a first blade having a first end and a second end, the first end of the first blade being sharply pointed;

a second blade having a first end and a second end, the first end of the second blade being sharply pointed;

a pivot connection for connecting the first blade and the second blade, the pivot connection being a pivot screw;

a serrated cutting edge having a plurality of cutting teeth formed on the first blade between the first end of the first blade and the pivot connection; and a plurality of serrated grooves formed on the second blade between the first end of the second blade and the pivot connection;

wherein the sharply pointed first end of the first blade and the sharply pointed, first end of the second blade creates a precision point;

wherein the precision point is created by the tip only of the scissors assembly being devoid of the serrated grooves and the cutting teeth to allow for a sharp cutting edge at the tip of the scissors assembly;

wherein the pivot screw is adjustable to adjust the interfit of the cutting teeth and the corresponding serrated grooves; and wherein upon pivoting of the first end of the first blade toward the first end of the second blade, the cutting teeth of the first blade interfit with the serrated grooves on the second blade.

2. The scissors assembly of claim 1 and further comprising:

a first handle portion formed on the second end of the first blade; and a second handle portion formed on the second end of the second blade.

3. The scissors assembly of claim 1 wherein the cutting teeth of the first blade extends along the entire first blade from the pivot connection to the first end of the first blade and the corresponding serrated grooves of the second blade extend along the entire second blade from the pivot connection to the first end of the second blade.

4. The scissors assembly of claim 1 wherein the cutting teeth of the first blade extends only partially along the entire first blade from the pivot connection to the first end of the first blade and the corresponding serrated grooves of the second blade extend only partially along the entire second blade from the pivot connection to the first end of the second blade.

5. The scissors assembly of claim 1 wherein the cutting teeth of the first blade extends almost completely along the entire first blade from the pivot connection to the first end of the first blade and the corresponding serrated grooves of the second blade extend almost completely along the entire second blade from the pivot connection to the first end of the second blade with only a portion of the first blade immediately adjacent the first end of the first blade and only a portion of the second blade immediately adjacent the first end of the second blade being free from the cutting teeth and the corresponding cutting grooves, respectively.

6. A scissors assembly for cutting objects, the scissors assembly comprising:

a first blade having a first end and a second end, the first end of the first blade being sharply pointed;

a second blade having a first end and a second end, the first end of the second blade being sharply pointed;

a pivot connection for connecting the first blade and the second blade;

a serrated cutting edge having a plurality of cutting teeth formed on the first blade between the first end of the first blade and the pivot connection;

a plurality of serrated grooves formed on the second blade between the first end of the second blade and the pivot connection;

a first handle portion formed on the second end of the first blade; and a second handle portion formed on the second end of the second blade;

wherein the sharply pointed first end of the first blade and the sharply pointed first end of the second blade creates a precision point;

wherein the precision point is created by the tip only of the scissors assembly being devoid of the serrated grooves and the cutting teeth to allow for a sharp cutting edge at the tip of the scissors assembly;

wherein upon pivoting of the first end of the first blade toward the first end of the second blade, the cutting teeth of the first blade interfit with the serrated grooves on the second blade; and wherein the pivot connection is a pivot screw, the pivot screw being adjustable to adjust the interfit of the cutting teeth and the corresponding serrated grooves.

7. The scissors assembly of claim 6 wherein the first handle portion and the second handle portion are sheathed with a padding material.

8. The scissors assembly of claim 6 wherein the cutting teeth of the first blade extends along the entire first blade from the pivot connection to the first end of the first blade and the corresponding serrated grooves of the second blade extend along the entire second blade from the pivot connection to the first end of the second blade.

9. The scissors assembly of claim 6 wherein the cutting teeth of the first blade extends only partially along the entire first blade from the pivot connection to the first end of the first blade and the corresponding serrated grooves of the second blade extend only partially along the entire second blade from the pivot connection to the first end of the second blade.

10. The scissors assembly of claim 6 wherein the cutting teeth of the first blade extends almost completely along the entire first blade from the pivot connection to the first end of the first blade and the corresponding serrated grooves of the second blade extend almost completely along the entire second blade from the pivot connection to the first end of the second blade with only a portion of the first blade immediately adjacent the first end of the first blade and only a portion of the second blade immediately adjacent the first end of the second blade being free from the cutting teeth and the corresponding cutting grooves, respectively.

* * * * *